United States Patent [19]

Buker

[11] 4,113,479

[45] Sep. 12, 1978

[54] VACUUM SMELTING PROCESS FOR PRODUCING FERROTUNGSTEN

[75] Inventor: Donald O. Buker, Lakewood, Colo.

[73] Assignee: AMAX Inc., Greenwich, Conn.

[21] Appl. No.: 768,386

[22] Filed: Feb. 14, 1977

Related U.S. Application Data

[63] Continuation-in-part of Ser. No. 661,978, Feb. 27, 1976, Pat. No. 4,039,325, which is a continuation-in-part of Ser. No. 508,848, Sep. 24, 1974, Pat. No. 3,966,459.

[51] Int. Cl.[2] ..... C22C 38/22

[52] U.S. Cl. ..... 75/211; 75/84; 75/90 R; 75/123 J; 75/133.5; 75/225

[58] Field of Search ..... 75/84, 90 R, 89, 123 J, 75/133, 135, 176, 133.5, 5, 200, 225, 211

[56] References Cited

U.S. PATENT DOCUMENTS

| | | | |
|---|---|---|---|
| 2,909,427 | 10/1959 | Rathmann et al. | 75/84 X |
| 3,107,165 | 10/1963 | Ham et al. | 75/84 X |
| 3,637,370 | 1/1972 | Buker | 75/84 X |
| 3,647,420 | 3/1972 | Restelli | 75/84 |
| 3,865,573 | 2/1975 | Neumann et al. | 75/84 X |
| 3,966,459 | 6/1976 | Buker | 75/84 |
| 3,999,981 | 12/1976 | Brandstatter | 75/84 |
| 4,039,325 | 8/1977 | Buker | 75/84 |

OTHER PUBLICATIONS

Kroll, W. J. et al., "Reactions of Carbon and Metal Oxides in a Vacuum", Trans. Electrochem. Soc., 93, pp. 247–258, 1948.

*Primary Examiner*—Richard E. Schafer
*Attorney, Agent, or Firm*—Harness, Dickey & Pierce

[57] ABSTRACT

A process for producing ferrotungsten alloys by forming a uniform mixture comprised of a finely-particulated tungsten-containing mineral, such as wolframite, scheelite, ferberite, and/or huebnerite; a supplemental quantity of a particulated iron-bearing material and a controlled amount of a carbonaceous reducing agent which is agglomerated into a plurality of pellets which are heated to an elevated temperature under a controlled vacuum for a period of time sufficient to effect a reduction of the tungstic oxide constituent to the metallic state and volatilization and extraction of the volatile constituents in the pellets, and an alloying of the metallic tungsten with the iron constituent, producing substantially dense sintered ferrotungsten alloy pellets.

14 Claims, No Drawings

VACUUM SMELTING PROCESS FOR PRODUCING FERROTUNGSTEN

CROSS-REFERENCE TO RELATED APPLICATIONS

This application is a continuation-in-part of my prior copending application Ser. No. 661,978, filed February 27, 1976, for "Vacuum Smelting Process for Producing Ferromolybdenum", now U.S. Pat. No. 4,039,325, which is a continuation-in-part of my prior copending application Ser. No. 508,848, filed Sept. 24, 1974, for "Process for Thermal Dissociation of Molybdenum Disulfide", now U.S. Pat. No. 3,966,459.

BACKGROUND OF THE INVENTION

The process as described in the aforementioned U.S. Pat. No. 3,966,459, is directed to a vacuum dissociation of a pelletized molybdenite concentrated feed material at an elevated temperature, producing pellets of relatively pure metallic molybdenum and the process as described in the aforementioned copending continuation-in-part application is directed to the further embodiment of producing ferromolybdenum alloys containing controlled amounts of iron and molybdenum by the vacuum smelting of a pelletized mixture comprised of a molybdenite concentrate and an iron-bearing material at an elevated temperature, producing ferromolybdenum alloy pellets which are eminently suitable for use as an alloying addition agent in steel-making operations and the like. The present continuation-in-part application is directed to still another embodiment of producing ferrotungsten alloys containing controlled amounts of iron and tungsten, which also are suitable for use as an alloying addition agent in iron and steelmaking operations.

Ferrotungsten alloys are produced in accordance with prior art practices by either employing a thermite process or an electric furnace reduction process. Both of these techniques require substantial amounts of labor and energy and are, therefore, somewhat costly. In the thermite process, for example, a tungstic oxide feed material derived from a chemical pretreatment of a tungsten ore concentrate is mixed with reducing agents, such as silicon and/or aluminum, which through an exothermic thermite-type reaction, produces an ingot or button of the ferro-alloy. The ferro-alloy button usually is of a segregated structure and further requires crushing and sizing prior to shipment and use. The slag produced, for economic reasons, is usually subjected to further treatment for recovery of residual metal values and the treated residue is discarded. In addition to the relatively high costs of the reducing agents required in the thermite process, further problems are presented from an environmental standpoint as a result of the disposal of the slag produced and the treatment required of the gases evolved during the exothermic reaction.

The present process overcomes many of the problems and disadvantages associated with prior art techniques for producing ferrotungsten alloys by utilizing a tungsten ore concentrate directly as the starting material without requiring costly chemical pretreatments to extract the tungstic oxide. Carbon is employed as a low-cost reducing agent, eliminating the formation of any slag, whereby a ferrotungsten alloy is obtained which is of a nonsegregated structure and is in the form of pellets, avoiding the necessity of subjecting the ferro-alloy to a crushing operation as in the case of buttons produced by the thermite process.

SUMMARY OF THE INVENTION

The benefits and advantages of the process comprising the present invention are achieved by forming a substantially uniform mixture composed of controlled amounts of a finely-particulated tungsten ore concentrate derived from minerals, such as wolframite, scheelite, ferberite and/or huebnerite; a supplemental quantity of a finely-particulated iron-bearing material present in an amount to adjust the iron content of the mixture to provide the desired iron concentration in the resultant ferrotungsten alloy produced, and a carbonaceous reducing agent such as carbon present in an amount slightly in excess of the stoichiometric quantity required to reduce the tungstic oxide and any iron oxide compounds present in the mixture to the metallic state. The resultant uniform mixture is agglomerated into a plurality of shape-retaining pellets, which thereafter are heated to an elevated temperature ranging from about 2500° F to about 3100° F under a vacuum of less than about 0.5 Torr (500 microns) for a period of time sufficient to effect a reduction of substantially all of the tungsten oxide compounds and any iron oxides present to the metallic state and to effect an alloying of the reduced metallic tungsten and iron to form a ferrotungsten alloy. The vacuum smelting of the pelletized feed material further effects a volatilization of the contaminating constituents in the pelletized feed material, which are continuously withdrawn together with the gaseous reaction products of the oxidized carbonaceous reducing agent. The gaseous effluent can be treated to effect an extraction and recovery of certain valuable volatilized constituents therein, such as manganese, for example, and the balance of the gaseous effluent after appropriate treatment can be harmlessly discharged to the atmosphere. The resultant ferrotungsten alloy in the form of relatively dense sintered pellets are cooled to a temperature of about 300° F or below, and thereafter are extracted from the vacuum smelting furnace.

Additional advantages and benefits of the present invention will become apparent upon a reading of the description of the preferred embodiments taken in conjunction with the specific examples provided.

DESCRIPTION OF THE PREFERRED EMBODIMENTS

The composition and concentration of the various feed materials, products, by-products and intermediate by-products, are described in the specification and subjoined claims in terms of percentages by weight unless clearly indicated to the contrary.

Sintered, dense pellets or briquettes of a ferrotungsten alloy of the desired composition are produced in accordance with the present process by forming a substantially uniform mixture of a finely-particulated tungsten ore concentrate, a carbonaceous reducing agent and some supplemental iron-bearing material, if necessary, to adjust the iron content within the desired concentration range. The mixture is agglomerated and thereafter heated at an elevated temperature in an environment devoid of oxygen and in a substantial vacuum in a manner to effect a direct reduction of the tungstic oxide constituent to form metallic tungsten and an alloying thereof with the iron constituent present to produce the ferrotungsten alloy.

The tungstic oxide ($WO_3$) constituent of the particulated mixture is introduced in the form of a finely-particulated tungsten containing mineral concentrate which preferably comprises predominately tungstic oxide. In accordance with conventional practices, tungstic oxide containing feed materials are commercially available as concentrates derived from various ore beneficiation processes to reduce the gangue and other contaminating constituents to concentrates usually containing at least 60%, and preferably at least 70%, tungstic oxide. Such beneficiation processes usually employ crushing, grinding, magnetic or gravity separation, flotation, or special chemical reactions to produce a particulated tungstic oxide concentrate. Common mineral sources containing tungsten oxide compounds which are suitable for producing concentrates for use in accordance with the practice of the present process include wolframite [$(FeMn)WO_4$]; ferberite [$FeWO_4$], which is the iron member of the wolframite family and contains some manganese; huebnerite [$MnWO_4$], which is the manganese member of the wolframite family and contains some iron; and scheelite [$CaWO_4$], which comprises essentially calcium tungstate.

The average particle size of the tungsten mineral concentrates for forming the mixture may range from about 10 microns to about 250 microns, while average particle sizes of from about 50 microns to about 125 microns are particularly satisfactory. Usually, beneficiation processes commercially employed effect a grinding or pulverizing of the mineral during the concentration process to an average particle size within the required range and no further supplemental grinding is required. However, in those instances in which the mineral concentrate is of an average particle size generally greater than about 250 microns, the concentrate is first subjected to a grinding operation to reduce its average particle size within the desired range.

In addition to the tungsten containing mineral concentrate, the mixture may further contain controlled amounts of an iron-bearing material which may comprise a finely-divided iron powder or an iron oxide powder present in a controlled amount so as to adjust the total iron concentration in the particulated mixture to produce a resultant ferrotungsten alloy having the desired iron content. Ferrotungsten alloys usually contain iron concentrations of from about 0.2% up to about 20%. When employing mineral concentrates derived from wolframite or ferberite, which inherently contain iron concentrations of from about 10% to as high as about 20%, the addition of a supplemental iron bearing material to the particulated mixture is normally not required. However, when employing mineral concentrates derived from heubnerite or scheelite, or when higher iron concentrations are desired in the resultant ferrotungsten alloy, the mixture can be supplemented by the addition of a metallic iron powder or iron oxide powder, as well as a mixture thereof to provide the requisite iron concentration. When the mixture contains an excessive concentration of iron, a controlled amount of iron can be removed by volatilization during the vacuum smelting operation by employing temperatures in the upper portion of the permissible temperature range.

When a metallic iron powder is employed as the iron-bearing constituent, the average particle size is not critical and may range from about 175 microns to about 74 microns, and preferably is controlled at an average particle size of about 125 microns to about 100 microns. When iron oxide is employed as the iron-bearing material, the iron oxide may suitably be introduced in the form of a fine-sized powder, preferably of an average particle size ranging from about 44 microns to about 10 microns. The iron oxide powder preferably comprises ferric oxide ($Fe_2O_3$), which may be conveniently derived from sources such as millscale, a by-product of hot rolling steel, or the like. When all or a portion of the iron-bearing constituent is introduced in the form of an iron oxide compound, an appropriate amount of carbonaceous reducing material or reducing agent is incorporated in the mixture to effect a substantially complete reduction of the iron oxide to the corresponding metallic state.

In addition to the mineral concentrate and any iron-bearing material, if employed, the particulated mixture contains a fine-sized particulated carbonaceous reducing agent, of which carbon powder itself of an average particle size ranging from about 44 microns to about 10 microns constitutes the preferred material. The quantity of carbon or other carbonaceous reducing agent is employed in an amount at least equal to that stoichiometrically required to effect a substantially complete reduction of the tungsten oxide and any iron oxide present to the metallic state in accordance with the following typical reaction equations:

$$WO_3 + 3C \rightarrow W + 3CO$$

$$2Fe_2O_3 + 6C \rightarrow 4Fe + 6CO$$

Preferably, the carbon reducing agent is employed in excess of that stoichiometrically required and is usually controlled within a stoichiometric ratio of from about 1.05 to about 1.20 times that theoretically required. Amounts of carbon above about 20% in excess of that stoichiometrically required are undesirable due to the retention of excessive carbon in the resultant ferrotungsten alloy pellets, rendering them less desirable as an alloying addition agent in some instances. It is also contemplated that small percentages of the carbonaceous reducing agent, such as carbon, can be incorporated when the iron bearing material comprises metallic iron powders for the purpose of reducing any oxides present on the iron particle surfaces. Generally employing the carbonaceous reducing agent in amount up to about 1% of the iron-bearing material employed is effective for this purpose and provides for ferrotungsten alloys of relatively high purity.

The mineral concentrate, the carbonaceous reducing agent and any supplemental iron-bearing constituent are blended mechanically in appropriate proportions to form a substantially homogeneous or uniform blend. It is important that the particulated mixture is first agglomerated into briquettes or pellets of a size which facilitates their handling and also assures the formation of a porous bed to permit an escape of the volatile constituents and gaseous reaction products of the oxidized reducing agent from the agglomerates during the vacuum smelting operation. The particular configuration and size of the pellets are not critical, and to some extent, will be dictated by the particular type of agglomerating process and equipment employed. Generally, pellets of a spherical configuration, such as derived from a disc-type pelletizing apparatus, having diameters ranging from about $\frac{1}{8}$ inch up to about $\frac{1}{2}$ inch, are satisfactory.

It is also important that the briquettes or pellets formed are of sufficient green strength so that they will not crush or deform when loaded as a static three-dimensional bed in a vacuum furnace, thereby assuring the retention of the porosity of the bed through which the volatile constituents and gaseous reaction products can escape during the vacuum smelting reaction. Adequate green strength to enable a preliminary handling of the pellets, as well as providing the requisite final strength necessary during the initial stage of the vacuum smelting operation, can be imparted to the agglomerates by incorporating any one of a variety of inexpensive binder materials which volatilize without leaving any substantial residue under the temperature and vacuum conditions present in the reactor. For this purpose, binder materials including starches, gelatins, sugars, molasses, sodium silicate, etc., can be employed, of which a dilute molasses solution has been found as being particularly satisfactory. Such binder materials are generally incorporated in amounts ranging from about 2% up to about 10%, with the specific amount used in any particular situation varying in consideration of such factors as the particular size of the tungsten mineral concentrate particles, the manner of agglomerating the particulated mixture and the size of the resultant pellets desired.

In accordance with a typical processing sequence, the tungsten containing particulated mineral concentrate is blended with an appropriate quantity of a powdered carbonaceous reducing agent in addition to a desired quantity of supplemental iron powder and/or iron oxide, whereafter appropriate quantities of binder are added. The resultant mixture is agglomerated into pellets of the desired size and shape and the green pellets are subsequently dried and transferred to a pellet storage hopper. The resultant pellets can be charged to a vacuum smelting furnace either on a batchwise basis or on a continuous basis, as may be desired, to effect a heating thereof to an elevated temperature in the absence of oxygen and under a relatively high vacuum so as to effect a direct reduction of the tungsten oxide constituents and any iron oxide constituents present and an extraction of the volatile contaminating constituents including the gaseous reaction products of the oxidized carbonaceous reducing agent, such as in the form of carbon monoxide. The vacuum furnace may suitably be evacuated employing a vacuum pump which preferably is of a steam ejector type and also effects a transfer of the vaporized constituents through suitable condensers for effecting a selected recovery thereof as by-products.

During the vacuum smelting operation, other constituents which are also volatilized and removed from the pelletized feed stock to effect a purification of the resultant ferrotungsten alloy residue include: silica, iron and iron compounds, calcium compounds, manganese and manganese compounds, aluminum compounds, lead compounds and other oxygen-containing compounds, as well as other conventional impurities normally found in ore deposits containing tungsten. The substantial reduction in the content of such contaminating constituents renders the resultant ferrotungsten alloy briquettes eminently suitable in many instances for direct use as metallurgical alloying agents in steel-making operations and the like without any further purification. A typical composition of ferrotungsten alloys, including permissible amounts of various contaminating constituents in accordance with ASTM specifications are as follows:

| | |
|---|---|
| Tungsten | 72.0 – 82.0% |
| Carbon | 0.60 max. |
| Phosphorous | 0.060 max. |
| Sulfur | 0.060 max. |
| Silicon | 1.00 max. |
| Manganese | 0.75 max. |
| Copper | 0.10 max. |
| Arsenic | 0.10 max. |
| Antimony | 0.080 max. |
| Tin | 0.10 max. |
| Total arsenic, antimony and tin | 0.20 max. |
| Iron | Balance |

The ferrotungsten pellets produced can be suitably packaged in steel containers providing premeasured quantities of the ferrotungsten alloy, and in that form can be utilized in steel-making and foundry operations.

The temperature of the pelletized feed stock during the vacuum smelting operation may range from as low as about 2500° F to as high as about 3100° F and preferably is controlled within a range of from about 2700° F to about 2900° F. Temperatures below about 2500° F are commercially unsatisfactory due to the slow rate of reduction of the tungsten oxide constituent, while on the other hand, temperatures above about 3100° F are undesirable because of excessive costs of refractories required in the vacuum smelting furnace. The vacuum smelting operation is carried out at pressures less than about 0.5 Torr and preferably at pressures less than about 0.05 Torr (50 microns) to as low as about 0.001 Torr (1 micron) and even lower, depending upon the limitations of the vacuum equipment employed. Particularly satisfactory results are achieved when the pelletized charge is heated at a temperature ranging from about 2800° F to about 3100° F employing a vacuum ranging from about 0.05 Torr to about 0.001 Torr.

The heating of the pelletized charge to within the desired temperature range is achieved at a rate as quickly as possible without incurring fracture or rupture of the pellets due to the rapid gasification of any moisture and other volatile constituents therein including the binder constituent, thereby producing pellets of a porous nature which become progressively more porous as the vacuum smelting reaction proceeds until a temperature is attained at which some sintering and densification of the pellets occurs. When iron oxide is employed in the pelletized feed stock as the source of the iron-bearing material, the reduction of iron oxide takes place commencing at a temperature of about 1800° F and is accompanied by a liberation of carbon monoxide gas. A reduction of the tungsten oxide constituent takes place commencing at a temperature of about 1800° F and the reaction itself is carried out for a period of time sufficient to effect a substantially complete reduction of the tungsten oxide constituent and of any iron oxide present to the metallic state. As metallic tungsten is produced during the course of the vacuum smelting reaction, the initial iron constituent present or the metallic iron produced by the reduction of the iron oxide constituent becomes alloyed with the tungsten, producing a nonsegregated substantially dense pellet of ferrotungsten alloy. Upon completion of the vacuum smelting operation, the pelletized charge is permitted to cool to a temperature below about 300° F whereafter the dense ferrotungsten alloy product can be extracted and exposed to air such as by back-filling the vacuum smelting furnace and the product recovered.

In order to further illustrate the process comprising the present invention, the following examples are provided. It will be understood that the examples hereinafter set forth are provided for illustrative purposes and are not intended to be limiting of the invention as herein described and as defined in the subjoined claims.

EXAMPLE

A pelletized charge is prepared from a finely-particulated wolframite mixture containing 47.82% tungsten, 7.4% iron, 13.96% carbon, 8.8% manganese, along with incidental amounts of other metallic impurities. The pelletized charge is heated in a furnace for a period of two hours at 2800° F under a vacuum of 10 microns, producing substantially dense sintered ferrotungsten alloy pellets. On analysis, the ferrotungsten alloy pellet product contains 87.04% tungsten, 8.33% iron, less than 0.01% carbon, and 0.016% manganese. The concentration of other contaminating elements in the wolframite feed mixture is reduced in the final pelletized product. The pelletized ferrotungsten alloy product represents a 96.2% recovery of the tungsten and 59% recovery of the iron present in the original feed material.

While it will be apparent that the invention herein described is well calculated to fulfill the objectives as hereinabove set forth, it will be appreciated that the invention is susceptible to modification, variation and change without departing from the spirit thereof.

What is claimed is:

1. A process for producing a ferrotungsten alloy which comprises the steps of forming a substantially uniform particulated mixture comprised of a finely-particulated tungsten containing mineral concentrate selected from the group consisting of wolframite, ferberite, huebnerite, scheelite and mixtures thereof; a finely-particulated iron-bearing material present in an amount to adjust the iron content in the resultant ferrotungsten alloy to the desired concentration, and a finely-particulated carbonaceous reducing agent present in an amount slightly in excess of the stoichiometric quantity required to reduce the tungsten oxide compounds and any iron oxide compounds present to the metallic state, agglomerating said mixture into a plurality of shape-retaining pellets, heating said pellets to an elevated temperature above about 2500° F while under a pressure of less than about 0.5 Torr for a period of time sufficient to effect a reduction of substantially all of the tungsten oxide compounds and any iron oxide compounds present to the metallic state and an alloying of the reduced metallic tungsten and iron to form a ferrotungsten alloy and to volatilize the contaminating constituents in said pellets, continuously withdrawing the gaseous volatilized contaminating constituents and gaseous reaction products of the oxidized said reducing agent, and thereafter cooling and extracting the substantially dense sintered ferrotungsten alloy pellets.

2. The process as defined in claim 1, in which the step of heating said pellets to an elevated temperature is performed up to a maximum of about 3100° F.

3. The process as defined in claim 1, in which the step of heating said pellets to an elevated temperature is performed so as to control the temperature within a range of about 2700° F to about 2900° F.

4. The process as defined in claim 1, in which the step of heating said pellets while under a reduced pressure is performed at a vacuum ranging from about 0.05 to about 0.001 Torr.

5. The process as defined in claim 1, in which the step of heating said pellets to an elevated temperature while under a reduced pressure is performed at an elevated temperature ranging from about 2800° F to about 3100° F at a vacuum of about 0.05 to about 0.001 Torr.

6. The process as defined in claim 1, including the further step of pulverizing said finely-particulated tungsten containing mineral concentrate to an average particle size ranging from about 10 up to about 250 microns.

7. The process as defined in claim 1, including the further step of pulverizing said finely-particulated tungsten containing mineral concentrate to an average particle size ranging from about 50 to about 125 microns.

8. The process as defined in claim 1, in which said carbonaceous reducing agent comprises carbon.

9. The process as defined in claim 1, in which said carbonaceous reducing agent is controlled in an amount of from about 1.05 to about 1.2 times the stoichiometric amount required to reduce the tungsten oxide compound and any iron oxide compounds present to the metallic state.

10. The process as defined in claim 1, wherein said finely-particulated iron-bearing material is introduced as a constituent of the tungsten containing mineral concentrate.

11. The process as defined in claim 1, in which said iron-bearing material is introduced in the form of a material selected from the group consisting of metallic iron, iron oxide and mixtures thereof present in an amount to adjust the iron content in the resultant ferrotungsten alloy within a range of about 0.2% to about 20%.

12. The process as defined in claim 1, wherein the step of agglomerating said mixture into a plurality of shape-retaining pellets includes the use of a fugitive binder present in an amount of about 2% to about 10%.

13. The process as defined in claim 1, in which the step of agglomerating said mixture is performed to produce substantially spherical pellets ranging from about $\frac{1}{8}$ inch to about $\frac{1}{2}$ inch in diameter.

14. The process as defined in claim 1, in which the step of cooling and extracting the substantially dense sintered ferrotungsten alloy pellets is performed to reduce their temperature below about 300° F before extraction.

* * * * *